US006676431B2

(12) United States Patent
Kukita et al.

(10) Patent No.: US 6,676,431 B2
(45) Date of Patent: Jan. 13, 2004

(54) PGA SOCKET AND CONTACT

(75) Inventors: Hiroaki Kukita, Yokohama (JP); Yoshifumi Nishida, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/124,083

(22) Filed: Apr. 17, 2002

(65) Prior Publication Data

US 2002/0155743 A1 Oct. 24, 2002

(30) Foreign Application Priority Data

Apr. 19, 2001 (JP) ..... 2001-120697

(51) Int. Cl.[7] ..... H01R 13/625
(52) U.S. Cl. ..... 439/342

(58) Field of Search ..... 439/342, 862

(56) References Cited

U.S. PATENT DOCUMENTS 5,980,323 A * 11/1999 Bricaud et al. ..... 439/862
6,375,485 B1 * 4/2002 Lin ..... 439/342

* cited by examiner

*Primary Examiner*—Gary Paumen
(74) *Attorney, Agent, or Firm*—Rosenthal & Osha L.L.P.

(57) ABSTRACT

Contacts 4 are held by a base housing 2 so that a whole body of each of the contacts 4 may be substantially housed in a contact hole 21 of the base housing and a surface 42*a* of a tail portion 42 of each of the contacts 4 may be on a plane substantially equal to a surface 2*a* of the base housing 2. Reduction in thickness of PGA sockets is hereby realized.

2 Claims, 9 Drawing Sheets

(a)

(b)

PGA SOCKET AND CONTACT

BACKGROUND OF THE INVENTION

The present invention relates to a PGA socket for use in connecting a PGA (Pin Grid Array) package provided with a plurality of pins in a grid array fashion to a printed circuit board and the like.

Of late years notebook type personal computers and the like have been required to be thin. As means for achieving thin thickness, attempts to reduce thickness of PGA sockets for use in connecting a PGA package to a printed circuit board have been made.

The PGA socket includes a base housing formed with contact holes in a grid array fashion, a plurality of contacts located in the contact holes, a cover housing formed with through holes in a grid array fashion through which pins of a PGA package can be inserted, and a sliding mechanism for sliding the cover housing over the base housing. Each contact includes a press-fitting portion for press-fitting the contact to be engaged in the base housing, a contact portion for being in contact with a pin of a PGA package, and a soldering portion for soldering the contact to a printed circuit board and the like.

Pins of the PGA package are inserted into the PGA socket through the through holes of the cover housing by zero insertion force to a position in which the pins of the PGA package face the contact portions of the contacts. The cover housing is slid over the base housing by sliding mechanism of the PGA socket and then the pins of the PGA package come in contact with the contact portions of the contacts to be electrically connected therewith.

However, there is a limit to the reduction in thickness of PGA socket because of a construction thereof where a definite length of the soldering portion projects into an outside of the base housing.

It is an object of the present invention to reduce thickness of PGA sockets in order to achieve thin thickness of notebook type personal computers and the like.

BRIEF SUMMARY OF THE INVENTION

A PGA socket of the present invention comprises a base housing formed with a large number of contact holes in a grid array fashion, a cover housing located to overlap the base housing and formed with a large number of through holes in a grid array fashion through which pins of a PGA package can be inserted, a sliding mechanism for sliding the cover housing over the base housing, and plurality of contacts held in the contact holes of the base housing and coming in contact with pins of a PGA package by sliding movement of the cover housing caused by the sliding mechanism, wherein a whole body of each of the contacts is substantially housed in the contact hole of the base housing and a surface of each of the contacts is on a plane substantially equal to an outer surface of the base housing opposite a surface of the base housing overlapping the cover housing.

According to the PGA socket, the whole body of the contact is substantially housed in the contact hole of the base housing and a soldered surface of the contact is on a plane substantially equal to an outer surface of the base housing. Ensuring electrically come in contact with the contacts and a printed circuit board and the like, reduction in thickness of PGA socket by a thickness equivalent to a portion of a conventional contact projecting into outside of the base housing can be realized. As a result, reduction in thickness of various kinds of equipment on which the PGA sockets are mounted can be realized.

The contact of the present invention held in the above-mentioned PGA socket to be in contact with a pin of a PGA package comprises a plate-like base portion and a tail portion provided continuously at one end of the base portion to substantially traverse the base portion in an orthogonal direction. The contact is in a shape to fit for the above-mentioned PGA socket because of the tail portion having a surface traversing the base portion in an orthogonal direction.

The contact of the present invention held in the above-mentioned PGA socket to be in contact with a pin of a PGA package comprises a plate-like base portion, a projecting portion provided continuously in the base portion to extend in a direction substantially equal to the base portion, a turned portion provided continuously at one end of the base portion to face the base portion, and a tail portion provided continuously at the other end of the base portion not to face the base portion. According to the contact, reduction in thickness of PGA socket can be realized. Also, it is possible to prevent flux from adhering on a contact surface for being in contact with a pin of a PGA package, thereby preventing a loose electrical connection of the pin and the contact.

BRIEF DESCRIPTION OF THE DRAWINGS

FIG. 7(*a*) shows the pins of a PGA package being inserted;

FIG. 7(*b*) shows the contacts and the pins being in contact;

FIG. 9(*a*) shows the pins of a PGA package being inserted;

FIG. 9(*b*) shows the contacts and the pins being in contact:

DETAILED DESCRIPTION OF THE PREFERRED EMBODIMENTS

Embodiments of the present invention will be described below with reference to the drawings.

A First Embodiment

Figure 1:
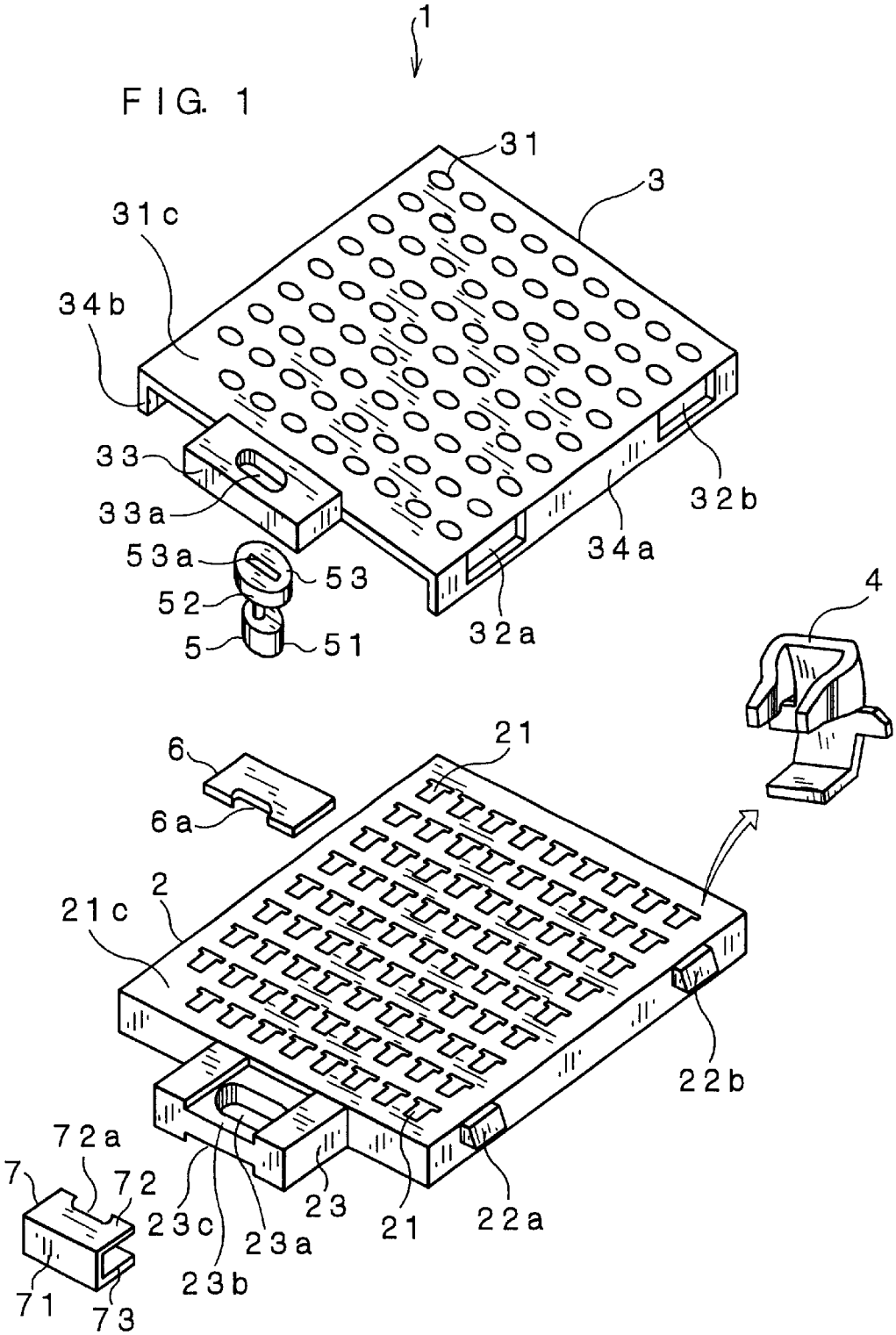
FIG. 1 shows an exploded perspective view of a PGA socket according to a first embodiment.

A PGA socket according to a first embodiment will be described with reference to FIGS. 1–7. FIG. 1 schematically shows an exploded perspective view of a PGA socket. FIG.

Figure 3:
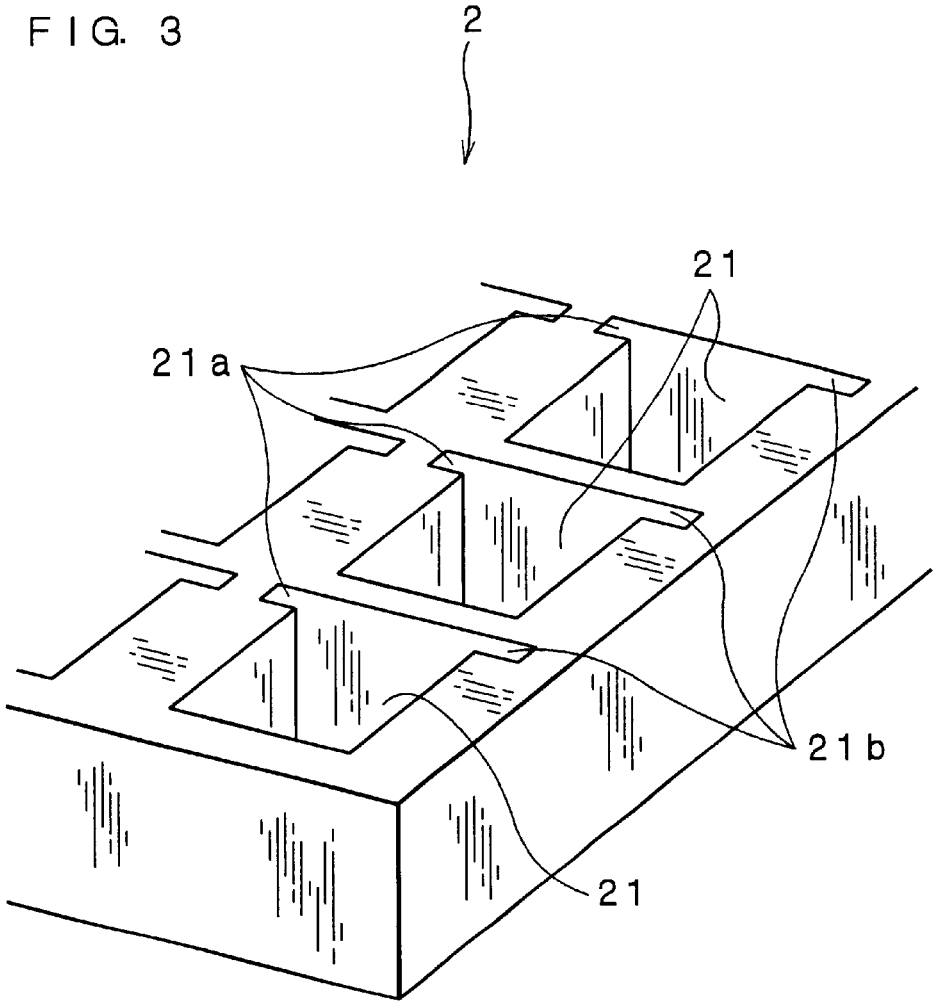
FIG. 3 shows a partially perspective view of a base housing used in the PGA socket shown in FIG. 1.
Figure 4:
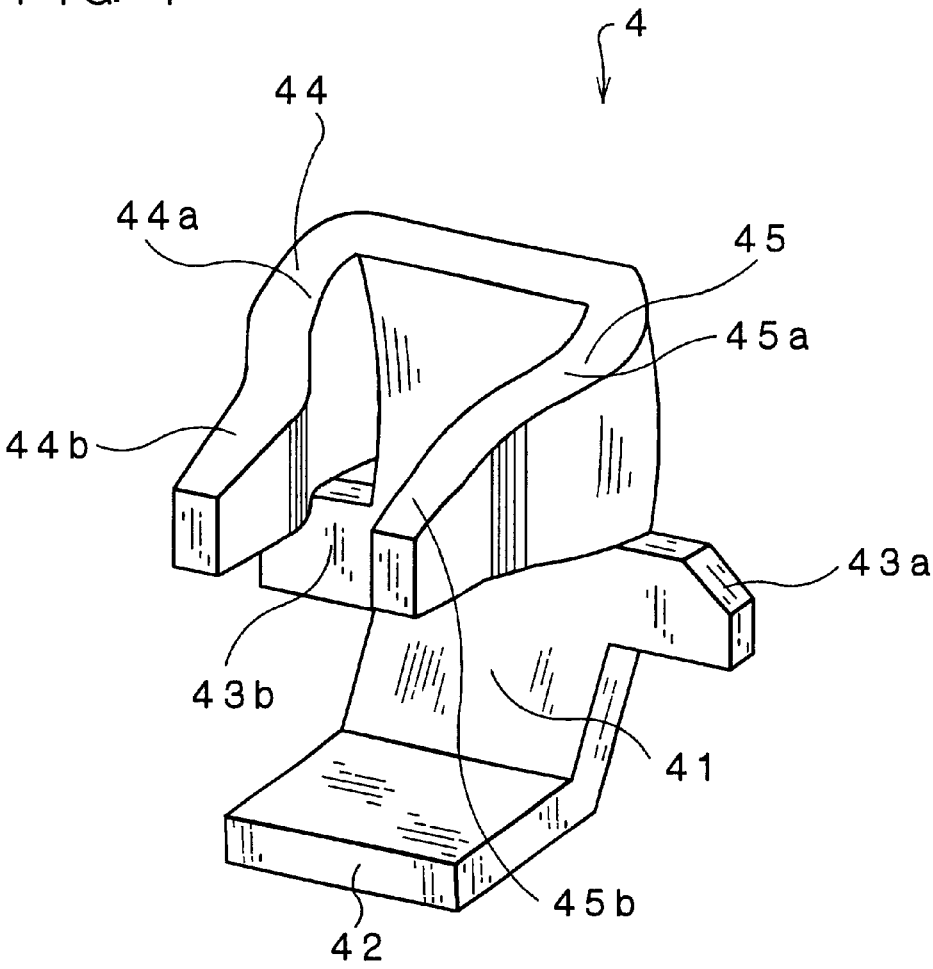
FIG. 4 shows a perspective view of a contact used in the PGA socket shown in FIG. 1.
Figure 5:
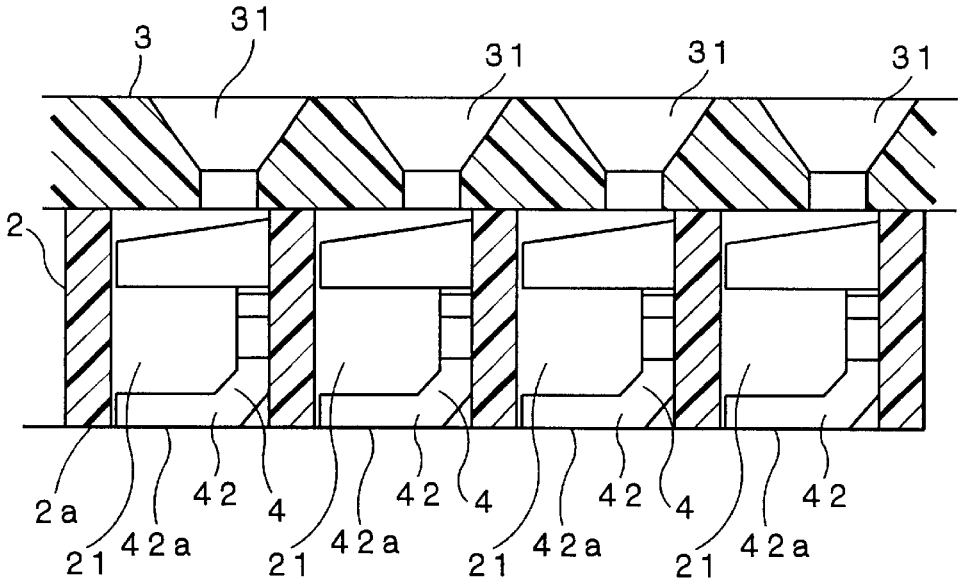
FIG. 5 shows a partially sectional view of the PGA socket shown in FIG. 2, taken at line I—I.
Figure 6:
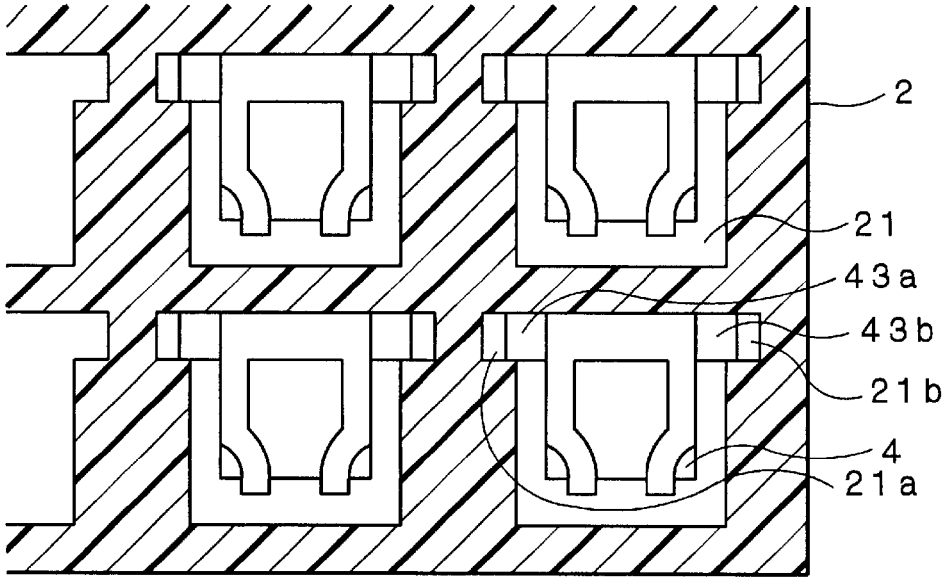
FIG. 6 is an explanatory diagram of contacts in the PGA socket shown in FIG. 1 being held by a base housing.
Figure 7:
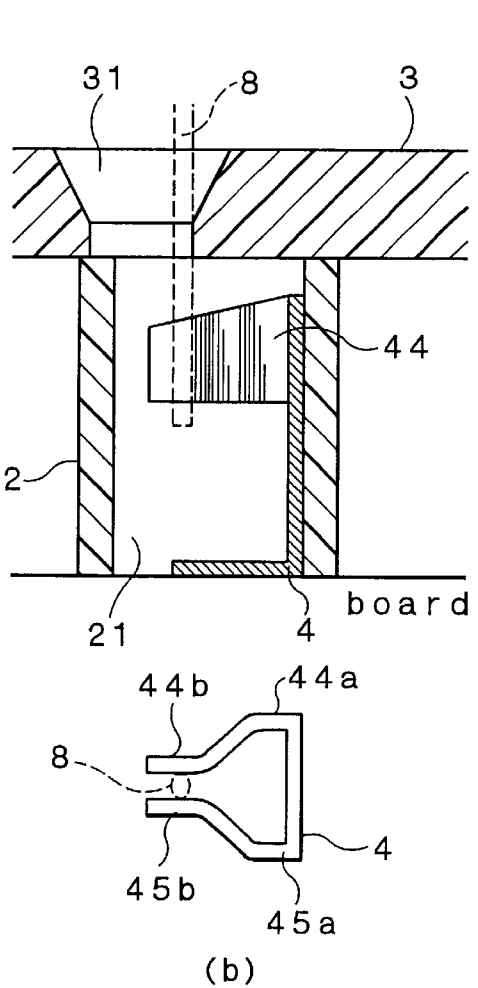
FIG. 7 is an explanatory diagram of pins of a PGA package and a PGA socket being in contact/noncontact.
Figure 7:
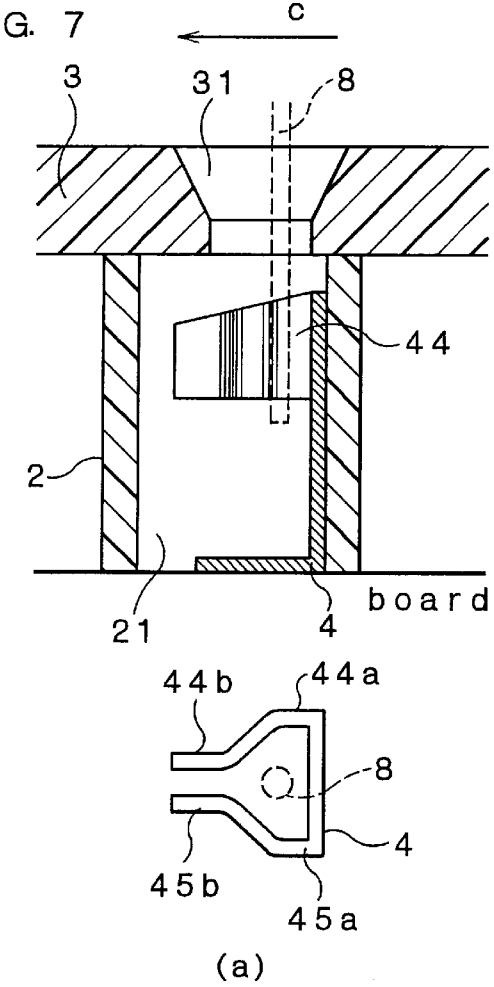

2 schematically shows a perspective view of a PGA socket. FIG. 3 shows a partially perspective view of a base housing of a PGA socket. FIG. 4 shows a perspective view of a contact of a PGA socket. FIG. 5 is an explanatory diagram of contacts being held by a PGA socket. FIG. 6 is an explanatory diagram of contacts being held by a base housing. FIG. 7 is an explanatory diagram of pins of a PGA package and PGA socket being in contact/noncontact.

Figure 2:
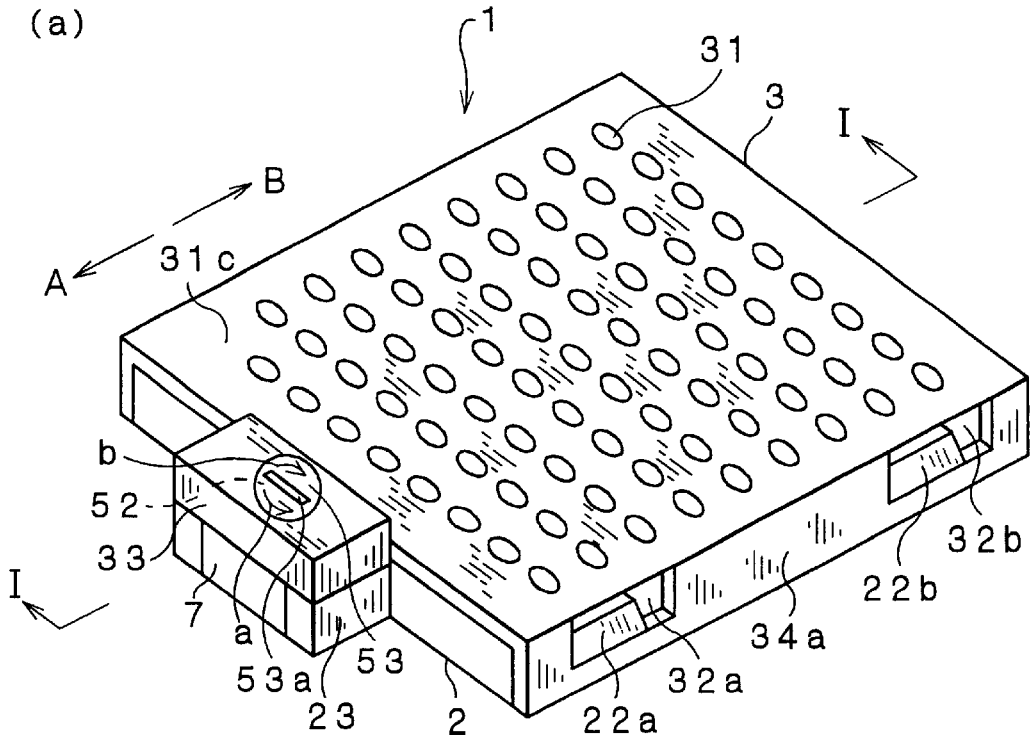
FIG. 2 shows a perspective view of the PGA socket shown in FIG. 1.
Figure 2:
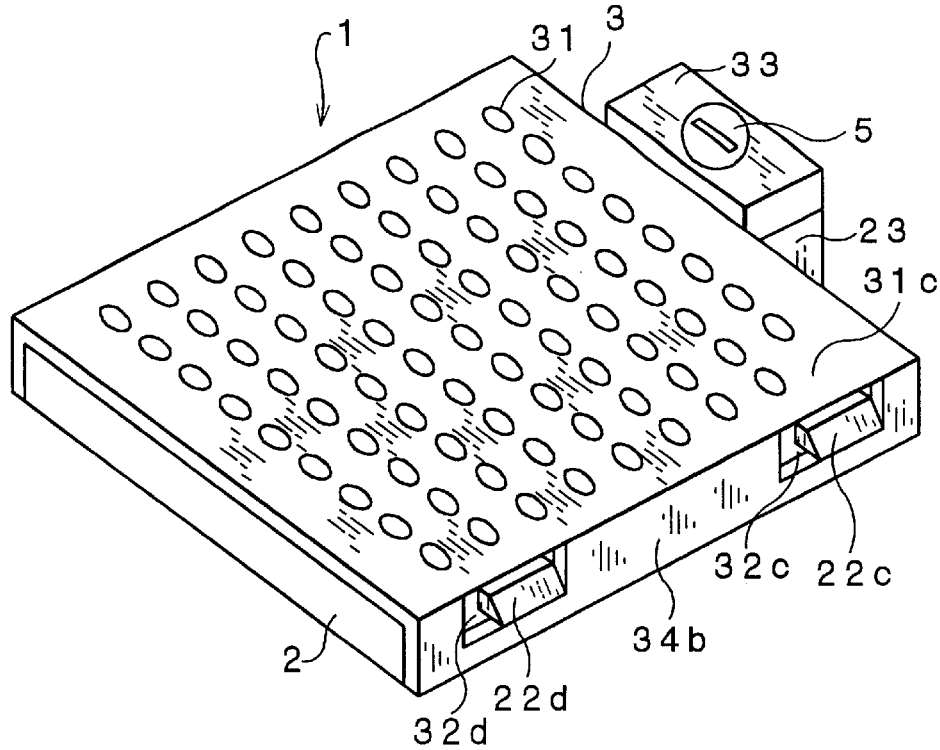

A PGA socket 1 according to the first embodiment shown in FIGS. 1 and 2 is a LGA (Land Grid Array) type socket. The PGA socket 1 comprises with a base housing 2, a cover housing 3 located to overlap the base housing 2, a plurality of contacts 4, an eccentric cam 5 and cam keeping plates 6, 7. The contacts 4 are made of conductive material. The base housing 2 and the cover housing 3 are made of nonconductive material.

The base housing 2 is formed with a plurality of contact holes 21 therethrough between upper and lower surfaces thereof in a grid array fashion. The contact hole 21 has substantially square-shaped cross section and is formed with concave portions 21*a*, 21*b* on ends of a pair of facing side surfaces. However, a part 21*c* is not formed with the contact holes 21 for preventing erroneous insertion.

The base housing 2 is provided with projecting portions 22*a*, 22*b* on a side surface, and with projecting portions 22*c*, 22*d* as well on another side surface facing thereto. The projecting portions 22*a*, 22*b*, 22*c*, and 22*d* are inserted into below-described opening portions 32*a*, 32*b*, 32*c*, and 32*d* of the cover housing 3 as shown in FIGS. 2(*a*) and (*b*). This prevents the base housing 2 and the cover housing 3 from easily detaching.

Further, the base housing 2 is provided with a substantially rectangular parallelepiped projecting portion 23 on a side surface where the projecting portions 22*a*, 22*b*, 22*c*, and 22*d* are not formed. The projecting portion 23 is formed with a slot-like through hole 23*a* therethrough between upper and lower surfaces and concave portions 23*b*, 23*c*, which are rectangular in a plan view, in which upper and lower surfaces of a region with through hole 23*a* formed thereon are included. The cam keeping plates 6, 7 are attached in the concave portions 23*b*, 23*c* respectively in a condition where below-described shaft section 51 of the eccentric cam 5 being inserted in the through hole 23*a*. Thereby the shaft section 51 is held in the through hole 23*a*.

The cover housing 3 is formed with a plurality of substantially circular through holes 31 therethrough between upper and lower surfaces in a grid array fashion into which the pins of a PGA package are inserted. However, a part 31*c* is not formed with the through holes 31 for preventing erroneous insertion. The through holes 31 are formed in positions in which the pins 8 of a PGA package do not contact contacts 4 at insertion into through holes 31 and come in contact with contacts 4 when the cover housing 3 slides over the base housing 2 after insertion (See FIG. 7).

The cover housing 3 is formed with a pair of extending portions 34*a*, 34*b* extending downwardly. The extending portion 34*a* is formed with rectangular opening portions 32*a*, 32*b*. The extending portion 34*b* is also formed with rectangular opening portions 32*c*, 32*d* in a similar way. A size of the height (length) direction of the opening portions 32*a*, 32*b*, 32*c*, 32*d* is substantially equal to a size for the projecting portions 22*a*, 22*b*, 22*c*, 22*d* to be inserted for the purpose of preventing the cover housing 3 from wobbling on the base housing 2 in a vertical direction. A size of the width direction of the opening portions 32*a*, 32*b*, 32*c*, 32*d* is wider than a size of the width direction of projecting portions 22*a*, 22*b*, 22*c*, 22*d* so that the pins 8 of a PGA package and the contacts 4 may be in contact and out of contact by sliding movement of the cover housing 3 over the base housing 2.

Further, the cover housing 3 is provided with a substantially rectangular parallelepiped projecting portion 33 on a side surface where the extending portions 34*a*, 34*b* are not formed. The projecting portion 33 has a slot-like through hole 33*a* therethrough between upper and lower surfaces. An eccentric portion 53, which is to be described below, of the eccentric cam 5 is inserted into the through hole 33*a*.

As shown in FIG. 4, the contact 4 includes a plate-like base portion 41, a tail portion 42 provided continuously at one end of the base portion 41 to traverse the base portion 41 in an orthogonal direction, a pair of projecting portions 43*a*, 43*b* provided continuously around centers of a pair of side surfaces of the base portion 41 to extend on a plane substantially equal to the base portion 41, and turned portions 44, 45 provided continuously at a side of the other end of the base portion 41 against the pair of projecting portions 43*a*, 43*b* to substantially traverse the base portion 41 in an orthogonal direction.

The tail portion 42 is soldered by cream solder for the PGA socket 1 to be mounted on a board. In short, the tail portion 42 functions as a soldering portion.

The projecting portions 43*a*, 43*b* are respectively press-fitted in concave portions 21*a*, 21*b* of the contact hole 21 formed on the base housing 2 (See FIG. 6). The contact 4 is hereby held by the base housing 2. In short, the projecting portions 43*a*, 43*b* function as press-fitting portions to the base housing 2.

The turned portions 44, 45 are bent in a middle thereof so that a distance between root portions 44*a*, 45*a*, formed by turning the base portion 41, may be longer than a distance between tip portions 44*b*, 45*b* of the turned portion 44, 45 respectively. Specifically, the turned portions 44, 45 are bent in a middle thereof so that a distance between root portions 44*a*, 45*a* may be longer than a diameter of a pin of a PGA package and a distance between the tip portions 44*b*, 45*b* may be slightly shorter than a diameter of the pin of a PGA package. Therefore, the pin of the PGA package and the turned portions 44, 45 are not in contact when the pin of a PGA package is inserted (See FIG. 7(*b*)). The pin of the PGA package and the tip portions 44*b*, 45*b* of the turned portions 44, 45 come in contact by sliding the pin after insertion (See FIG. 7(*b*)). The tip portions 44*b*, 45*b* of the turned portions 44, 45 are elastically deformed due to this connection. In short, the turned portions 44, 45 function as contact portions which come in contact with the pins 8.

As shown in FIG. 5, the contacts 4 are substantially housed in the contact holes 21 of the base housing 2 and surfaces 42*a*, which are not facing the turned portions 44, 45 of the tail portions 42 of the contacts 4, are on a plane substantially equal to a surface 2*a* opposite a surface of the base housing 2 overlapping the cover housing 3, in a condition where the contacts 4 are held in the contact holes 21 of the base housing 2.

The eccentric cam 5 functions as a sliding mechanism for sliding the cover housing 3 over the base housing 2. The eccentric cam 5 includes a cylindrical shaft section 51, a cylindrical connecting section 52 extending from one end surface of the shaft section 51 in an axial direction of the shaft section 51, and an eccentric section 53 extending from one end surface of the connection section 52 in an axial direction of the connection section 52. The shaft section 51 is in axial alignment with the connection section 52 and is not in axial alignment with the eccentric section 53. A rectangular concave portion 53*a* for fitting an operating tool such as flat blade screwdrivers is formed on the eccentric section 53. The shaft section 51 is inserted into the through hole 23*a* of the base housing 2 and the eccentric section 53 is inserted into the through hole 33*a* of the cover housing 3. The eccentric cam 5 is of a height substantially equal to an entire height of the projecting portion 23 of the base housing 2 and the projecting portion 33 of the cover housing 3 overlapping each other. The connection section 52 is of a height substantially equal to a depth of the concave portion 23*b* of the projecting portion 23 of the base housing 2.

By turning a flat blade screwdriver fitted to the concave portion 53*a* in direction of arrow a in FIG. 2(*a*), the cover housing 3 is slid over the base housing 2 in direction of arrow A in FIG. 2(*a*). By turning the screwdriver in direction of arrow b in FIG. 2(*a*), the cover housing 3 is slid in direction of arrow B in FIG. 2(*a*).

The substantially rectangular cam keeping board 6 is of a thickness substantially equal to a depth of the concave portion 23*b* of the projecting portion 23 of the base housing 2. The cam keeping board 6 is provided with a half slot-like notch 6*a* in a center of one side surface thereof. In a PGA socket 1 in an assembled condition, the cam keeping board 6 is located in the concave portion 23*b* of the base housing 2, so that a side surface thereof facing the side surface with the notch 6a may be on a base housing 2 side.

The can keeping board 7 includes a rectangular side plate 71, an upper plate 72 extending from a top of the side plate 71 in cross direction, and a lower plate 73 extending from a bottom of the side plate 71 in a direction equal to the upper plate 72. The upper plate 72 is provided with a half slot-like notch 72*a* in a center of a side surface that is not in succession with the side plate 71. The upper plate 72 is of a thickness substantially equal to a depth of the concave portion 23*b* of the projecting portion 23 of the base housing 2. The lower plate 73 is of a thickness substantially equal to a depth of the concave portion 23*c* of the projecting portion 23 of the base housing 2. A distance between the upper plate 72 and the lower plate 73 is substantially equal to a thickness of a section provided with the concave portions 23*b*, 23*c* of the projecting portion 23 of the base housing 2. The cam keeping board 7 is mounted on the projecting portion 23 of the base housing 2 so that the upper and lower plates 72 and 73 may be located in the concave portions 23*b* and 23*c* of the base housing 2 respectively.

The connection section 52 is located in a slot formed with the notch 6*a* of the cam keeping board 6 and the notch 72*a* of the cam keeping board 7. A size of the slot is smaller than a size of the shaft section 51 of the eccentric cam 5 to prevent the eccentric cam 5 from detaching. Therefore, it is possible to prevent the eccentric cam 5 from detaching from the PGA socket 1, ensuring turn of the eccentric cam 5.

An assembled condition of PGA socket will be described below.

The shaft section 51 of the eccentric cam 5 is inserted into the trough hole 23*a* of the projecting portion 23 of the base housing 2. The cam keeping board 6 is located in the concave portion 23*b* of the projecting portion 23 of the base housing 2. And the cam keeping board 7 is mounted on the projecting portion 23 of the base housing 2 so that the upper and lower plates 72 and 73 of the cam keeping board 7 may be located in the concave portions 23*b* and 23*c* of the projecting portion 23 of the base housing 2 respectively. Further, the cover housing 3 is mounted on the base housing 2 so that the base housing 2 may be located between the extending portions 34*a* and 34*b* of the cover housing 3 and the projecting portions 22*a*, 22*b*, 22*c*, 22*d* of the base housing 2 may be inserted into the opening portions 32*a*, 32*b*, 32*c*, 32*d* of the cover housing 3.

As shown in FIG. 6, a plurality of contacts 4 are held in the contact holes 21 of the base housing 2 respectively. As shown in FIG. 5, a whole body of each of the contacts 4 is substantially housed in the contact hole 21 of the base housing 2 and the surface 42*a* of the tail portion 42 of each of the contacts 4 is on a plane equal to the surface 2*a* of the base housing 2 in a condition where the contacts 4 are held in the contact holes 21.

A relationship of positions of contacts 4 and pins 8 will be described below.

When a PGA package is mounted on the PGA socket, each pin 8 of a PGA package is inserted into the contact hole 21 of the base housing 2 through the through hole 31 of the cover housing 3 until the pin 8 faces the root portions 44*a*, 45*a* of the turned portions 44, 45 of the contact 4 in a position therebetween without contacting the cover housing 3 and the base housing 2, as shown in FIG. 7(*a*). The contact 4 and the pin 8 are not in contact in this condition.

When the eccentric cam 5 is turned by flat blade screwdriver in direction of arrow a in FIG. 2(*a*) in the above-mentioned condition, the cover housing 3 is slid over the base housing 2 in direction of arrow A in FIG. 2, that is, in direction of arrow C in FIG. 7(*a*). While the cover housing 3 is being slid, an inner wall of the through hole 31 of the cover housing 3 comes in contact with the pin 8. Then the pin 8 moves in direction of arrow C in FIG. 7(*a*) by being pushed by the cover housing 3. As shown in FIG. 7(*b*), the pin 8 reaches a point between the tip portions 44*b*, 45*b* of the turned portions 44, 45 of the contact 4 to be in contact with the tip portions 44*b*, 45*b* of the turned portions 44, 45. At this time, the pin 8 elastically deforms the turned portions 44, 45 slightly by pressing the contact portions 44*b*, 45*b* in a direction where the turned portions 44, 45 traverse the base portion 41 orthogonally and a distance between the turned portions 44, 45 becomes longer. Hereby the pins 8 and the contact portions 44*b*, 45*b* press each other by elastic restoring force of the turned portions 44, 45.

As described above, in the PGA socket 1 according to the first embodiments of the present invention, a whole body of each of the contacts 4 is substantially housed in the contact hole 21 so that the surface 42*a* of the tail portion 42 of each of the contacts 4 may be on a plane equal to the surface 2*a* of the base housing 2. Therefore, the PGA socket can be thinner in thickness than conventional PGA sockets having a construction where a tail portion as a soldering portion is projecting into outside. As a result, reduction in thickness of various kinds of equipment can be realized by using the PGA socket according to the embodiments of the present invention therein.

A Second Embodiment

A second embodiment is a variant of the PGA socket according to the first embodiment, where a contact is deformed. It is noted that the concave portions 21*a*, 21*b* are formed in the projecting portion 23 side of the contact holes 21 and a direction of a contact is opposite to a direction of the contact of the first embodiment.

A contact of PGA socket will be described with reference to FIGS. 8 and 9 in the second embodiment.

Figure 8:
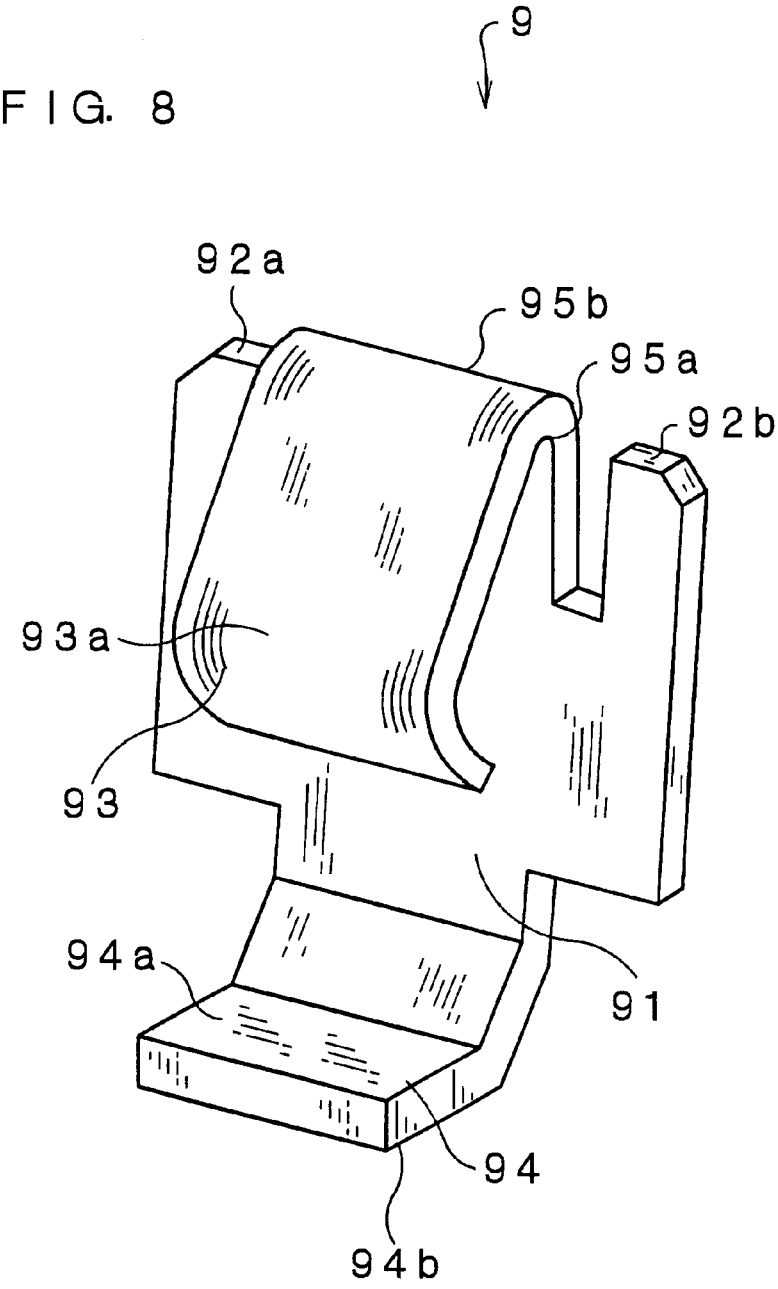
FIG. 8 schematically shows a perspective view of a contact used in a PGA socket according to a second embodiment.

A contact 9 according to the second embodiment shown in FIG. 8 includes a plate-like base portion 91, a pair of projecting portions 92*a*, 92*b* provided continuously at one end of the base portion 91 to extend in a direction substantially equal to the base portion 91, a turned portion 93 provided continuously at the one end of the base portion 91 to face the base portion 91, being bent to have a contact portion 93*a* projecting into an opposite side of the base portion 91, and a tail portion 94 provided continuously at the other end of the base portion 91 to be substantially perpendicular to the base portion 91. The projecting portions 92*a*, 92*b* function as press-fitting portions. The turned portion 93 functions as a contact portion. The tail portion 94 functions as a soldering portion. The contact 9 is held by the base housing 2 so that a whole body of the contact 9 may be held in the contact hole 21 and a lower surface 94*b* of the tail portion 94 may be on a plane substantially equal to a surface 2*a* opposite a surface of the base housing 2 overlapping the cover housing 3 (See FIGS. 9(*a*) and (*b*)).

In the contact 9 of the above-mentioned construction, usually flux does not adhere on the contact portion 93*a* of the turned portion 93 since flux passes from the tail portion 94 over a surface of the base portion 91 facing the turned portion 93.

To adhere on the contact portion 93*a* after passing over the surface of the base portion 91 facing the turned portion 93, flux is required to rise from the tail portion 94 to boundaries 95*a*, 95*b* dividing the base portion 91 and the turned portion 93 through the base portion 91 and then move along the turned portion 93. Usually, the more flux rises, the more energy is needed. Accordingly, flux is unlikely to reach the boundaries 95*a*, 95*b* that are on higher position for the soldered tail portion 94. Therefore, flux is unlikely to adhere on the contact surface of the contact portion 93*a* of the contact 9.

Figure 9:
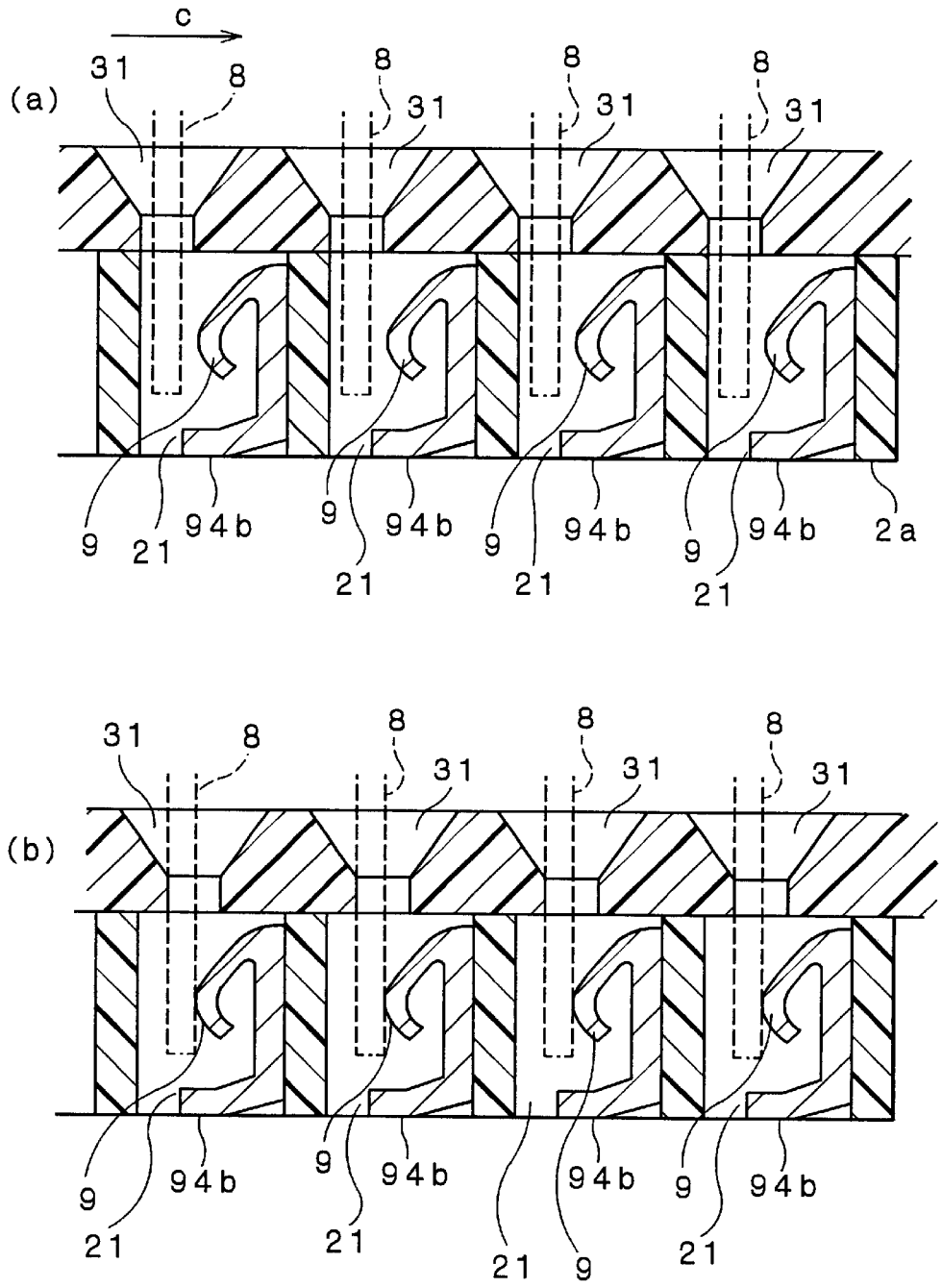
FIG. 9 is an explanatory diagram of pins of a PGA package and a PGA socket being in contact/noncontact.

In a PGA socket provided with the contacts 9 of the above-mentioned construction, when the PGA package is mounted on a PGA socket, pins 8 of a PGA package are inserted through the through holes 31 of the cover housing 3 into the contact holes 21 of the base housing 2 to a position in which the pins 8 of a PGA package face the turned portions 93 of the contacts 9 without contacting the cover housing 3 and the base housing 2, as shown in FIG. 9(*a*). The contact 9 and the pin 8 are not in contact yet in this condition. When the eccentric cam 5 is turned by flat blade screwdriver in this condition, the cover housing 3 is slid over the base housing 2 in direction of arrow C in FIG. 9(*a*). While the cover housing 3 is being slid, inner walls of the through holes 31 thereof come in contact with the pins 8. Then the pins 8 move in direction of arrow C in FIG. 9(*a*) by being pushed by the cover housing 3. As shown FIG. 9(*b*), the pins 8 are hereby in contact with the contact portions 93*a* of the turned portions 93 of the contacts 9.

Similar to the PGA socket of the first embodiment, the PGA socket provided with the above-mentioned contacts 9 can be thinner in thickness than a conventional PGA socket having a construction where the tail portion as a soldering portion is projecting into outside. As a result, reduction in thickness of various kinds of equipment can be realized by using the PGA sockets according to the second embodiment of the present invention therein.

Further, the above-mentioned contact 9 has a construction where flux usually does not adhere on the contact portion 93*a* thereof. Since the contacts 9 are used in the PGA socket, a loose electrical connection of the pins 8 of a PGA package and the contacts 4 is prevented, resulting in increase in yield of products.

Although the preferred embodiments of the present invention have been described, the present invention is not limited thereto. Various changes and modifications to the preferred embodiments are possible within the scope of the invention claimed. For example, shapes of contact are not limited to the shapes of the contacts 4 and 9 so long as the contact is held in the base housing so that the lower surface of the tail portion of the contact may be on a plane equal to the surface 2*a* of the base housing 2.

From a viewpoint as reduction in thickness of PGA socket, the contact 4 is preferably housed in the contact hole 21 of the base housing 2 so that the surface 42*a* of the tail portion 42 of the contact 4 may be on a plane equal to the surface 2*a* of the base housing 2. However, there is an adverse possibility that the contact 4 is not electrically connected to a substrate when the surface 42*a* of the tail portion 42 is located in the base housing 2 more inwardly than the surface 2*a* of the base housing 2. Accordingly, the surface 42*a* of the tail portion 42 may be formed to locate slightly outside of the surface 2*a* of the base housing 2.

What is claimed is:

1. A PGA socket comprising:

a base housing formed with a large number of contact holes in a grid array fashion, a cover housing located to overlap the base housing and formed with a large number of through holes in a grid array fashion, a sliding mechanism for sliding the cover housing over the base housing, and plurality of contacts held in the contact holes of the base housing and coming in contact with pins of a PGA package by sliding movement of the cover housing caused by the sliding mechanism, wherein a whole body of each of the contacts is substantially housed in the contact hole of the base housing and a bottom surface of each of the contacts is on a plane substantially equal to an outer bottom surface of the base housing opposite a surface of the base housing overlapping the cover housing, wherein each of the contacts comprises:

a plate-like base portion extending in a vertical plane, a projecting portion provided continuously in the base portion to extend in a direction substantially equal to the base portion, a turned portion provided continuously at one end of the base portion to face the base portion, and a tail portion provided continuously at the other end of the base portion not to face the base portion.

2. A PGA socket comprising:

a base housing formed with a large number of contact holes in a grid array fashion, a cover housing located to overlap the base housing and formed with a large number of through holes in a grid array fashion, a sliding mechanism for sliding the cover housing over the base housing, and plurality of contacts held in the contact holes of the base housing and coming in contact with pins of a PGA package by sliding movement of the cover housing caused by the sliding mechanism, wherein a whole body of each of the contacts is substantially housed in the contact hole of the base housing and a bottom surface of each of the contacts is on a plane substantially equal to an outer bottom surface of the base housing opposite a surface of the base housing overlapping the cover housing, and wherein each of the contacts is symmetrical to a centerline in a direction orthogonal to a plane of the base housing where the contact holes are formed in a grid array fashion.

* * * * *